US012729481B2

(12) United States Patent
Kimura et al.

(10) Patent No.: US 12,729,481 B2
(45) Date of Patent: Sep. 8, 2026

(54) COMPOSITION CONTAINING FIRST TREATMENT AGENT FOR SYNTHETIC FIBER, METHOD FOR PREPARING DILUTED SOLUTION OF TREATMENT AGENT FOR SYNTHETIC FIBER, METHOD FOR TREATING SYNTHETIC FIBER, METHOD FOR PRODUCING SYNTHETIC FIBER, AND METHOD FOR PRODUCING SHORT FIBER

(71) Applicant: TAKEMOTO YUSHI KABUSHIKI KAISHA, Aichi-ken (JP)

(72) Inventors: Yutaka Kimura, Gamagori (JP); Tomoya Okada, Gamagori (JP); Ikki Kaneko, Gamagori (JP)

(73) Assignee: TAKEMOTO YUSHI KABUSHIKI KAISHA, Aichi (JP)

( * ) Notice: Subject to any disclaimer, the term of this patent is extended or adjusted under 35 U.S.C. 154(b) by 0 days.

(21) Appl. No.: 18/706,205

(22) PCT Filed: Oct. 26, 2022

(86) PCT No.: PCT/JP2022/039818
§ 371 (c)(1),
(2) Date: Apr. 30, 2024

(87) PCT Pub. No.: WO2023/080023
PCT Pub. Date: May 11, 2023

(65) Prior Publication Data

US 2024/0328074 A1 Oct. 3, 2024

(30) Foreign Application Priority Data

Nov. 2, 2021 (JP) ..... 2021-179634

(51) Int. Cl.
*D06M 13/292* (2006.01)
*D06M 15/53* (2006.01)
*D06M 101/32* (2006.01)

(52) U.S. Cl.
CPC ..... *D06M 13/292* (2013.01); *D06M 15/53* (2013.01); *D06M 2101/32* (2013.01); *D06M 2200/40* (2013.01)

(58) Field of Classification Search
CPC ..... D06M 13/292
See application file for complete search history.

(56) References Cited

FOREIGN PATENT DOCUMENTS

| | | | | | |
|---|---|---|---|---|---|
| JP | S57-66182 | A | | 4/1982 | |
| JP | S61-119777 | A | | 6/1986 | |
| JP | H03-8870 | A | | 1/1991 | |
| JP | H03-234866 | A | | 10/1991 | |
| JP | H08151391 | A | * | 6/1996 | |
| JP | H10-212664 | A | | 8/1998 | |
| JP | 2002-030571 | A | | 1/2002 | |
| JP | 5574712 | B2 | * | 8/2014 | ..... D06M 13/17 |
| JP | 2016-216857 | A | | 12/2016 | |
| JP | 6348246 | B1 | | 6/2018 | |
| TW | 201741521 | A | | 12/2017 | |
| WO | WO 2009/098845 | A1 | | 8/2009 | |
| WO | WO 2016/002476 | A1 | | 1/2016 | |
| WO | WO 2019/239597 | A1 | | 12/2019 | |
| WO | WO 2022/138688 | A1 | | 6/2022 | |

OTHER PUBLICATIONS

Inagaki et al. English machine translation of JP2002030571 A. (Year: 2002).*
Minami et al. English machine translation of JP 5574712 B2. (Year: 2014).*
Fujio et al. English machine translation of JPH08151391A. (Year: 1996).*
International Search Report and Written Opinion dated Dec. 27, 2022, in connection with International Application No. PCT/JP2022/039818 (with Machine Translation).
Notice of Reasons for Refusal mailed Dec. 14, 2021, in the corresponding JP patent application No. 2021-179634 (with Machine Translation).
Notice of Review Opinion mailed Mar. 28, 2023, in the corresponding TW patent application No. 111140625 (with Machine Translation).

* cited by examiner

*Primary Examiner* — Peter F Godenschwager
(74) *Attorney, Agent, or Firm* — Wolf, Greenfield & Sacks, P.C.

(57) ABSTRACT

Disclosed is a first agent-containing composition for treating synthetic fiber that is combined in use with a second agent for treating synthetic fiber containing a specific nonionic surfactant. The first agent-containing composition contains a first agent for treating synthetic fiber and a solvent. The first agent contains specific organic phosphoric acid ester salts at specific ratios and has a specific acid value. The solvent has a boiling point at atmospheric pressure of not more than 105° C. Assuming that the sum of the amounts of the first agent and the solvent contained in the first agent-containing composition is 100 parts by mass, the amount of the first agent contained in the first agent-containing composition is not less than 35 parts by mass and not more than 55 parts by mass.

10 Claims, 1 Drawing Sheet

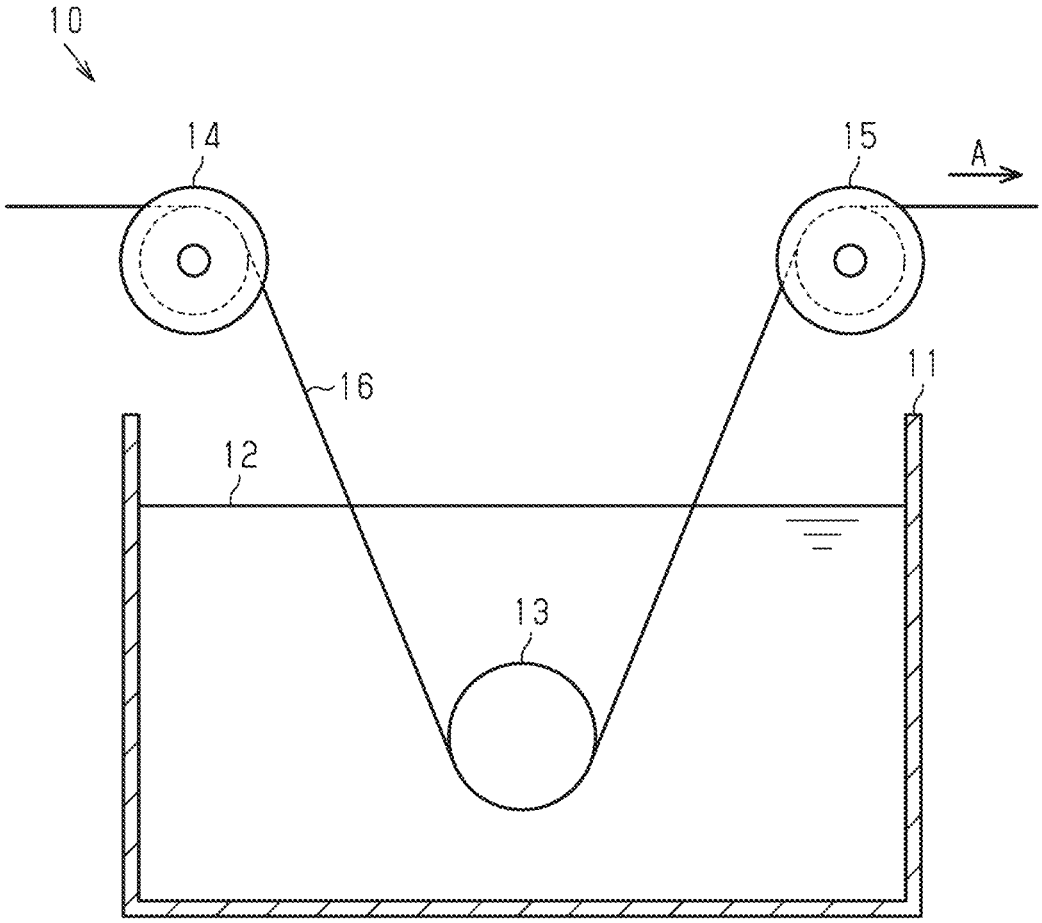
10
14
15
A
16
11
12
13

COMPOSITION CONTAINING FIRST TREATMENT AGENT FOR SYNTHETIC FIBER, METHOD FOR PREPARING DILUTED SOLUTION OF TREATMENT AGENT FOR SYNTHETIC FIBER, METHOD FOR TREATING SYNTHETIC FIBER, METHOD FOR PRODUCING SYNTHETIC FIBER, AND METHOD FOR PRODUCING SHORT FIBER

CROSS REFERENCE TO RELATED APPLICATIONS

This Application is a national stage filing under 35 U.S.C. 371 of International Patent Application Serial No PCT/JP2022/039818, filed Oct. 26, 2022, which claims priority to Japanese application number 2021-179634, filed Nov. 2, 2021. The entire contents of these applications are incorporated herein by reference in their entirety.

TECHNICAL FIELD

The present invention relates to a first agent-containing composition for treating synthetic fiber that contains an organic phosphoric acid ester salt, a method for preparing a dilute liquid of synthetic fiber treatment agent, a method for treating synthetic fiber, a method for producing synthetic fiber, and a method for producing short fiber.

BACKGROUND ART

Generally, a synthetic fiber treatment agent may adhere to the surface of a synthetic fiber from standpoints of, for example, reducing friction and improving antistatic property in a fiber spinning and drawing process and a finishing process of the synthetic fiber.

Patent Document 1 discloses a known polyester synthetic fiber treatment agent. The polyester synthetic fiber treatment agent of Patent Document 1 contains a long-chain alkyl phosphoric acid ester salt, a short-chain alkyl phosphoric acid ester salt, an inorganic phosphoric acid salt, and a nonionic surfactant at predetermined ratios. The long-chain alkyl phosphoric acid ester salt is an alkali metal salt of an alkyl phosphoric acid ester in which the number of carbon atoms in an alkyl group is 16 to 18. The short-chain alkyl phosphoric acid ester salt is an alkali metal salt of an alkyl phosphoric acid ester in which the number of carbon atoms in an alkyl group is 4 to 8. The inorganic phosphoric acid salt is a hydrogen phosphoric acid dimetal salt or a phosphoric acid trimetal salt.

CITATION LIST

Patent Literature

Patent Document 1: Japanese Patent No. 6348246

SUMMARY OF INVENTION

Technical Problem

Further improvement of the stability properties of a treatment agent is demanded.

Solution to Problem

As a result of performing research toward solving the above problem, the inventors of the present application found that in a synthetic fiber treatment agent, an arrangement separated into a first agent for treating synthetic fiber that contains specific organic phosphoric acid ester salts at specific ratios and has a specific acid value and a second agent for treating synthetic fiber that contains a specific surfactant is suitable.

To solve the above problem and in accordance with one aspect of the present invention, a first agent-containing composition for treating synthetic fiber is provided that is combined in use with a second agent for treating synthetic fiber containing a nonionic surfactant (C) described below. The first agent-containing composition for treating synthetic fiber is separate from the second agent for treating synthetic fiber when not in use, and contains a first agent for treating synthetic fiber described below and a solvent (S) described below. Assuming that the sum of the amounts of the first agent for treating synthetic fiber and the solvent (S) contained in the first agent-containing composition for treating synthetic fiber is 100 parts by mass, the amount of the first agent for treating synthetic fiber contained in the first agent-containing composition for treating synthetic fiber is not less than 35 parts by mass and not more than 55 parts by mass.

The first agent for treating synthetic fiber contains an organic phosphoric acid ester salt (A) described below, an organic phosphoric acid ester salt (B) described below, and optionally a nonionic surfactant (C) described below. The first agent for treating synthetic fiber has a mass ratio of the sum of the contents of the organic phosphoric acid ester salt (A) and the organic phosphoric acid ester salt (B) and the content of the nonionic surfactant (C) such that (organic phosphoric acid ester salt (A)+organic phosphoric acid ester salt (B))/nonionic surfactant (C) is 95/5 to 100/0. Assuming that the sum of the amounts of the organic phosphoric acid ester salt (A) and the organic phosphoric acid ester salt (B) contained in the first agent for treating synthetic fiber is 100 parts by mass, the amount of the organic phosphoric acid ester salt (A) contained in the first agent for treating synthetic fiber is not less than 80 parts by mass but less than 100 parts by mass and the amount of the organic phosphoric acid ester salt (B) contained in the first agent for treating synthetic fiber is more than 0 parts by mass but not more than 20 parts by mass. The first agent for treating synthetic fiber has an acid value of more than 0 mg KOH/g but not more than 18 mg KOH/g, as measured by a potentiometric titration method.

The solvent (S) has a boiling point at atmospheric pressure of not more than 105° C.

The organic phosphoric acid ester salt (A) is an alkali metal salt of an organic phosphoric acid ester having a hydrocarbon group with not less than 16 and not more than 18 carbon atoms.

The organic phosphoric acid ester salt (B) is an alkali metal salt of an organic phosphoric acid ester having a hydrocarbon group with not less than 4 and not more than 8 carbon atoms.

The nonionic surfactant (C) has a (poly) oxyalkylene structure in the molecule.

In the first agent-containing composition for treating synthetic fiber, the acid value of the first agent for treating synthetic fiber measured by the potentiometric titration method may be more than 1 mg KOH/g but not more than 16 mg KOH/g.

In the first agent-containing composition for treating synthetic fiber, the solvent (S) may be water.

To solve the above problem and in accordance with another aspect of the present invention, a method for preparing a dilute liquid of synthetic fiber treatment agent is provided that includes adding the first agent-containing composition for treating synthetic fiber and the second agent for treating synthetic fiber to water such that first agent for treating synthetic fiber/second agent for treating synthetic fiber is 20/80 to 80/20 (mass ratio) and the dilute liquid has a nonvolatile concentration of not less than 0.01% by mass and not more than 10% by mass.

The method for preparing a dilute liquid of synthetic fiber treatment agent may include, a first step described below and a second step described below.

The first step is a step of adding the first agent-containing composition for treating synthetic fiber and the second agent for treating synthetic fiber to a first water to prepare a dilute liquid of synthetic fiber treatment agent with a nonvolatile concentration of more than 2% by mass but not more than 10% by mass.

The second step is a step of adding a second water to the dilute liquid of synthetic fiber treatment agent prepared in the first step to prepare a dilute liquid of synthetic fiber treatment agent with a nonvolatile concentration of not less than 0.01% by mass and not more than 2% by mass.

In the method for preparing a dilute liquid of synthetic fiber treatment agent, the first step may include adding the first agent-containing composition for treating synthetic fiber and the second agent for treating synthetic fiber to water of not less than 60° C. and not more than 95° C. that is of not less than 20% by mass and not more than 70% by mass of the total amount of the first water and thereafter further adding the remaining first water of not more than 40° C.

In the method for preparing a dilute liquid of synthetic fiber treatment agent, the first step may include adding the first agent-containing composition for treating synthetic fiber to water of not less than 60° C. and not more than 95° C. that is of not less than 20% by mass and not more than 70% by mass of the total amount of the first water, thereafter further adding the remaining first water of not more than 40° C., and then further adding the second agent for treating synthetic fiber.

To solve the above problem and in accordance with another aspect of the present invention, a method for treating synthetic fiber is provided that includes applying, to a synthetic fiber, a dilute liquid of synthetic fiber treatment agent obtained by adding the first agent-containing composition for treating synthetic fiber and the second agent for treating synthetic fiber to water.

To solve the above problem and in accordance with another aspect of the present invention, a method for producing synthetic fiber is provided that includes applying, to a synthetic fiber, a dilute liquid of synthetic fiber treatment agent obtained by adding the first agent-containing composition for treating synthetic fiber and the second agent for treating synthetic fiber to water.

To solve the above problem and in accordance with another aspect of the present invention, a method for producing short fiber is provided that includes applying, to a synthetic fiber, a dilute liquid of synthetic fiber treatment agent obtained by adding the first agent-containing composition for treating synthetic fiber and the second agent for treating synthetic fiber to water.

Advantageous Effects of Invention

The present invention succeeds in improving the stability properties of a treatment agent.

BRIEF DESCRIPTION OF DRAWINGS

FIG. 1 is a schematic view of a friction testing device for evaluation of drawability in the Examples section.

DESCRIPTION OF EMBODIMENTS

First Embodiment

A first embodiment that embodies a first agent-containing composition for treating synthetic fiber of the present invention (hereinafter referred to as "first treatment agent-containing composition") will now be described. The first treatment agent-containing composition of the present embodiment contains a first agent for treating synthetic fiber (hereinafter referred to as "first treatment agent") and a solvent (S).

(First Treatment Agent)

The first treatment agent used in the first treatment agent-containing composition of the present embodiment contains an organic phosphoric acid ester salt (A), an organic phosphoric acid ester salt (B), and optionally a nonionic surfactant (C).

(Organic Phosphoric Acid Ester Salt (A))

The organic phosphoric acid ester salt (A) is an alkali metal salt of an organic phosphoric acid ester having a hydrocarbon group with not less than 16 and not more than 18 carbon atoms.

The hydrocarbon group constituting the organic phosphoric acid ester salt (A) may be a saturated hydrocarbon group or may be an unsaturated hydrocarbon group. Alternatively, it may be a straight-chain hydrocarbon group or may be a hydrocarbon group having a branched chain. Specific examples of a straight-chain saturated hydrocarbon group include a hexadecyl group, a heptadecyl group, and an octadecyl group. Specific examples of a saturated hydrocarbon group having a branched chain structure include an isohexadecyl group, an isoheptadecyl group, and an isooctadecyl group.

The unsaturated hydrocarbon group may be an alkenyl group having one double bond as an unsaturated carbon bond or may be an alkadienyl group or alkatrienyl group having two or more double bonds. Alternatively, it may be an alkynyl group having one triple bond as an unsaturated carbon bond or may be an alkadiynyl group having two or more triple bonds. Specific examples of a straight-chain unsaturated hydrocarbon group having one double bond in the hydrocarbon group include a hexadecenyl group, a heptadecenyl group, and an octadecenyl group. Specific examples of an unsaturated hydrocarbon group having a branched chain structure and having one double bond in the hydrocarbon group include an isohexadecenyl group, an isoheptadecenyl group, and an isooctadecenyl group.

Specific examples of an alkali metal that constitutes the alkali metal salt include sodium, potassium, and lithium.

Specific examples of the organic phosphoric acid ester salt (A) include potassium stearyl phosphoric acid ester (2.5), potassium stearyl phosphoric acid ester (2.6), potassium stearyl phosphoric acid ester (2.8), potassium stearyl phosphoric acid ester (3.0), potassium cetylstearyl (30:70) phosphoric acid ester (2.6), potassium cetylstearyl (20:80) phosphoric acid ester (2.8), potassium cetylstearyl (50:50)

phosphoric acid ester (2.5), potassium cetylstearyl (50:50) phosphoric acid ester (2.8), potassium cetylstearyl (60:40) phosphoric acid ester (2.5), and potassium cetylstearyl (70:30) phosphoric acid ester (3.0).

As used herein, the numerical value in parentheses indicated after cetylstearyl expresses a mass ratio of cetyl alcohol and stearyl alcohol used as raw materials. Also as used herein, the numerical value in parentheses indicated at the end of each specific example expresses a molar ratio of alcohol with respect to diphosphorus pentaoxide used as raw materials. With an organic phosphoric acid ester salt using two or more types of alcohols, the molar ratio of the raw material alcohol with respect to diphosphorus pentaoxide, as used herein, was calculated using a theoretical molecular weight calculated from the contents of the respective alcohols. For example, in the case of cetyl alcohol (molecular weight: 242.44): stearyl alcohol (molecular weight: 270.49) =30:70, the theoretical molecular weight of cetylstearyl (30:70) alcohol is 242.44×0.3+270.49×0.7=262.08.

With these organic phosphoric acid ester salts (A), one type of organic phosphoric acid ester salt may be used alone or two or more types of organic phosphoric acid ester salts may be used in combination as appropriate.

(Organic Phosphoric Acid Ester Salt (B))

The organic phosphoric acid ester salt (B) is an alkali metal salt of an organic phosphoric acid ester having a hydrocarbon group with not less than 4 and not more than 8 carbon atoms.

The hydrocarbon group constituting the organic phosphoric acid ester salt (B) may be a saturated hydrocarbon group or may be an unsaturated hydrocarbon group. Alternatively, it may be a straight-chain hydrocarbon group or may be a hydrocarbon group having a branched chain. Specific examples of a straight-chain saturated hydrocarbon group include a butyl group, a pentyl group, a hexyl group, and an octyl group. Specific examples of a saturated hydrocarbon group having a branched chain structure include an isobutyl group, an isopentyl group, an isohexyl group, and an isooctyl group.

The unsaturated hydrocarbon group may be an alkenyl group having one double bond as an unsaturated carbon bond or may be an alkadienyl group or alkatrienyl group having two or more double bonds. Alternatively, it may be an alkynyl group having one triple bond as an unsaturated carbon bond or may be an alkadiynyl group having two or more triple bonds. Specific examples of a straight-chain unsaturated hydrocarbon group having one double bond in the hydrocarbon group include a butenyl group, a pentenyl group, a hexenyl group, a heptenyl group, and an octenyl group. Specific examples of an unsaturated hydrocarbon group having a branched chain structure and having one double bond in the hydrocarbon group include an isobutenyl group, an isopentenyl group, an isohexenyl group, an isoheptenyl group, and an isooctenyl group.

Specific examples of an alkali metal that constitutes the alkali metal salt include sodium, potassium, and lithium.

Specific examples of the organic phosphoric acid ester salt (B) include potassium butyl phosphoric acid ester (1.8), potassium butyl phosphoric acid ester (2.5), potassium hexyl phosphoric acid ester (2.0), potassium hexyloctyl (50:50) phosphoric acid ester (1.8), potassium 2-ethylhexyl phosphoric acid ester (2.6), and potassium octyl phosphoric acid ester (3.0).

With these organic phosphoric acid ester salts (B), one type of organic phosphoric acid ester salt may be used alone or two or more types of organic phosphoric acid ester salts may be used in combination as appropriate.

Assuming that the sum of the amounts of the organic phosphoric acid ester salt (A) and the organic phosphoric acid ester salt (B) contained in the first treatment agent is 100 parts by mass, the amount of the organic phosphoric acid ester salt (A) contained in the first treatment agent is not less than 80 parts by mass but less than 100 parts by mass and the amount of the organic phosphoric acid ester salt (B) contained in the first treatment agent is more than 0 parts by mass but not more than 20 parts by mass. By specifying to be in such range, the stability properties, especially stability under temperature change, of the first treatment agent-containing composition can be improved.

(Nonionic Surfactant (C))

The nonionic surfactant (C) is a nonionic surfactant having a (poly) oxyalkylene structure in the molecule. Examples of the nonionic surfactant (C) include an alkylene oxide adduct of an alcohol or a carboxylic acid, an ether ester compound in which an alkylene oxide is added to an ester compound of a carboxylic acid and a polyhydric alcohol, an alkylene oxide adduct of an amine compound such as an alkylamine.

Specific examples of an alcohol used as a raw material of the nonionic surfactant include (1) straight-chain alkyl alcohols, such as methanol, ethanol, propanol, butanol, pentanol, hexanol, octanol, nonanol, decanol, undecanol, dodecanol, tridecanol, tetradecanol, pentadecanol, hexadecanol, heptadecanol, octadecanol, nonadecanol, eicosanol, heneicosanol, docosanol, tricosanol, tetracosanol, pentacosanol, hexacosanol, heptacosanol, octacosanol, nonacosanol, and triacontanol, (2) branched alkyl alcohols, such as isobutanol, isohexanol, 2-ethylhexanol, isononanol, isodecanol, isododecanol, isotridecanol, isotetradecanol, isopentadecanol, isohexadecanol, isoheptadecanol, isooctadecanol, isononadecanol, isoeicosanol, isoheneicosanol, isodocosanol, isotricosanol, isotetracosanol, isopentacosanol, isohexacosanol, isoheptacosanol, isooctacosanol, isononacosanol, and isotriacontanol, (3) straight-chain alkenyl alcohols, such as tetradecenol, hexadecenol, heptadecenol, octadecenol, and nonadecenol, (4) branched alkenyl alcohols, such as isohexadecenol and isooctadecenol, (5) cyclic alkyl alcohols, such as cyclopentanol and cyclohexanol, and (6) aromatic alcohols, such as phenol, nonylphenol, benzyl alcohol, monostyrenated phenol, distyrenated phenol, and tristyrenated phenol.

Specific examples of a carboxylic acid used as a raw material of the nonionic surfactant include (1) straight-chain alkyl carboxylic acids, such as octylic acid, nonanoic acid, decanoic acid, undecanoic acid, dodecanoic acid, tridecanoic acid, tetradecanoic acid, pentadecanoic acid, hexadecanoic acid, heptadecanoic acid, octadecanoic acid, nonadecanoic acid, eicosanoic acid, heneicosanoic acid, and docosanoic acid, (2) branched alkyl carboxylic acids, such as 2-ethylhexanoic acid, isododecanoic acid, isotridecanoic acid, isotetradecanoic acid, isohexadecanoic acid, and isooctadecanoic acid, (3) straight-chain alkenyl carboxylic acids, such as octadecenoic acid, octadecadienoic acid, and octadecatrienoic acid, (4) aromatic-based carboxylic acid, such as benzoic acid, (5) hydroxycarboxylic acids, such as ricinoleic acid, and (6) animal and plant derived fatty acids, such as castor oil fatty acid, sesame oil fatty acid, tall oil fatty acid, soybean oil fatty acid, rapeseed oil fatty acid, coconut oil fatty acid, lard fatty acid, and beef tallow fatty acid.

Specific examples of an alkylene oxide used as a raw material for forming the (poly) oxyalkylene structure of the nonionic surfactant include ethylene oxide and propylene oxide. The number of moles of alkylene oxide added is set as appropriate and is preferably not less than 0.1 moles and not more than 60 moles, more preferably not less than 1 mole and not more than 40 moles, and even more preferably not less than 2 moles and not more than 30 moles. Any combination of the abovementioned upper and lower limits may be used. The number of moles of alkylene oxide added represents the number of moles of the alkylene oxide with respect to 1 mole of the alcohol or the carboxylic acid in the charged raw materials. If a plurality of types of alkylene oxides are used, these may be arranged as a block adduct or a random adduct.

Specific examples of a polyhydric alcohol used as a raw material of the nonionic surfactant include ethylene glycol, propylene glycol, 1,3-propanediol, 1,2-butanediol, 1,3-butanediol, 1,4-butanediol, 2-methyl-1,2-propanediol, 1,5-pentanediol, 1,6-hexanediol, 2,5-hexanediol, 2-methyl-2,4-pentanediol, 2,3-dimethyl-2,3-butanediol, glycerin, 2-methyl-2-hydroxymethyl-1,3-propanediol, 2-ethyl-2-hydroxymethyl-1,3-propanediol, trimethylolpropane, sorbitan, pentaerythritol, and sorbitol.

Specific examples of an alkylamine used as a raw material of the nonionic surfactant include methylamine, ethylamine, butylamine, octylamine, laurylamine, octadecylamine, and coconut amine.

Specific examples of the nonionic surfactant (C) include polyoxyethylene alkyl ethers, polyoxyethylene alkenyl ethers, polyoxyethylene polyoxypropylene alkyl ethers (block adducts, random adducts), polyoxyethylene polyoxypropylene alkenyl ethers (block adducts, random adducts), polyoxypropylene alkyl ethers, polyoxypropylene alkenyl ethers, polyoxyethylene adducts of oils and fats, polyoxyethylene polyoxypropylene adducts of oils and fats (random adducts, block adducts), polyoxyethylene fatty acid esters, polyoxyethylene polyoxypropylene fatty acid esters (random adducts, block adducts), polyoxyethylene alkyl amine ethers, acid neutralization products of polyoxyethylene alkyl amine ethers, polyoxyethylene polyhydric alcohol ether fatty acid esters, and polyoxyethylene polyoxypropylene polyhydric alcohol ether fatty acid esters (random adducts, block adducts).

With these nonionic surfactants (C), one type of nonionic surfactant may be used alone or two or more types of nonionic surfactants may be used in combination as appropriate.

The upper limit of the content of the nonionic surfactant (C) in the first treatment agent is preferably not more than 5% by mass, more preferably not more than 2% by mass, and even more preferably not more than 1% by mass. By specifying the content to be not more than 5% by mass, the stability properties of the first treatment agent can be improved further.

The first treatment agent has a mass ratio of the sum of the contents of the organic phosphoric acid ester salt (A) and the organic phosphoric acid ester salt (B) and the content of the nonionic surfactant (C) such that (organic phosphoric acid ester salt (A)+organic phosphoric acid ester salt (B))/nonionic surfactant (C) is 95/5 to 100/0. By being in such range, the stability properties of the first treatment agent-containing composition can be improved.

(Acid Value)

The first treatment agent has an acid value of more than 0 mg KOH/g but not more than 18 mg KOH/g and preferably more than 1 mg KOH/g but not more than 16 mg KOH/g, as measured by a potentiometric titration method. By specifying to be in such range, the stability properties, especially stability under temperature change, of the first treatment agent-containing composition can be improved. The handleability of the first treatment agent-containing composition can also be improved. Any combination of the abovementioned upper and lower limits may be used. The organic phosphoric acid ester salt (A) and the organic phosphoric acid ester salt (B) are each obtained, for example, by making diphosphorus pentaoxide react with the raw material alcohol to obtain a phosphoric acid ester and thereafter neutralizing the phosphoric acid ester as necessary by an alkali, such as potassium hydroxide. The acid value can be adjusted by, for example, adjusting the degree of neutralization.

(Solvent(S))

The solvent (S) is a solvent with a boiling point at atmospheric pressure of not more than 105° C. Examples of the solvent (S) include water and an organic solvent. Specific examples of the organic solvent include lower alcohols, such as ethanol and propanol, and low polarity solvents, such as hexane. With these solvents(S), one type of solvent may be used alone or two or more types of solvents may be used in combination as appropriate. Among these, a polar solvent, such as water or a lower alcohol, is preferable from a standpoint of making a mixture in which the first treatment agent and a second agent for treating synthetic fiber (hereinafter referred to as "second treatment agent") are mixed with each other be of emulsion form, and water is more preferable from a standpoint of being excellent in handleability of the first treatment agent-containing composition.

Assuming that the sum of the amounts of the first treatment agent and the solvent (S) contained in the first treatment agent-containing composition is 100 parts by mass, the amount of the first treatment agent contained in the first treatment agent-containing composition is not less than 35 parts by mass and not more than 55 parts by mass. By making the first treatment agent be of not less than 35 parts by mass, the stability properties of the first treatment agent-containing composition can be improved. By making the first treatment agent be of not more than 55 parts by mass, the handleability of the first treatment agent-containing composition can be improved.

(Second Treatment Agent)

The first treatment agent-containing composition is combined in use with the second treatment agent that contains the nonionic surfactant (C). The first treatment agent-containing composition is separate from the second treatment agent before use, for example, during preservation or during distribution. In use, the first treatment agent-containing composition and the second treatment agent are mixed with each other to prepare a synthetic fiber treatment agent to be used. The second treatment agent will now be described. The second treatment agent contains the nonionic surfactant (C) described above and may have blended therein other ingredients as necessary.

(Other Ingredients)

In accordance with application purpose or necessity and within ranges in which the effects of the present invention are not impaired, the second treatment agent may further contain an ingredient other than the ingredients described above, such as a solvent, a polyhydric alcohol, a mineral oil, which is a smoothing agent, an ester, a silicone compound, an anionic surfactant, a chelating agent, or a carboxylic acid salt. Specific examples of the solvent include those described in the solvent (S) section above. The content of the solvent in the second treatment agent is preferably not more than 20% by mass from a standpoint of improvement of product appearance and stability properties.

Specific examples of the polyhydric alcohol include propylene glycol, diethylene glycol, ethylene glycol, and glycerin. Specific examples of the mineral oil include paraffin wax and hydrotreated light paraffin. Specific examples of the ester include sorbitan monooleate, sorbitan monostearate, glycerin monooleate, and castor oil. Specific examples of the silicone include polydimethylsiloxane. Specific examples of the anionic surfactant include potassium laurate, potassium oleate, sodium lauryl sulfate, sodium alkyl (C14 to C16) sulfonates, and sodium dioctyl sulfosuccinate. Specific examples of the chelating agent include disodium ethylene diamine tetraacetate and trisodium ethylenediamine-N,N'-disuccinate. Specific examples of the carboxylic acid salt include potassium lactate and potassium acetate.

Effects of the first treatment agent-containing composition of the embodiment will now be described.

(1-1) The first treatment agent-containing composition of the embodiment contains the first treatment agent and the solvent (S). The first treatment agent contains the organic phosphoric acid ester salt (A) and others at predetermined ratios and has an acid value of more than 0 mg KOH/g but not more than 18 mg KOH/g, as measured by a potentiometric titration method. The synthetic fiber treatment agent is configured by the first treatment agent-containing composition and the second treatment agent that contains the nonionic surfactant (C), which are separate from each other before use, for example, during preservation or during distribution. In use, the first treatment agent-containing composition and the second treatment agent are mixed with each other to prepare the synthetic fiber treatment agent to be used.

By such a method, the stability properties of the first treatment agent-containing composition and the second treatment agent that constitute the synthetic fiber treatment agent can be improved. Effects of the organic phosphoric acid ester salts and other functional ingredients contained in the synthetic fiber treatment agent can thereby be exhibited effectively. Also, the handleability of the first treatment agent-containing composition can be improved.

(1-2) The first treatment agent-containing composition of the embodiment has, among stability properties, improved stability at room temperature, which is a type of preservation stability. There are cases where the stability properties of a composition decrease further under temperature change in a low temperature region, especially during the winter season. By the arrangement of the first treatment agent-containing composition of the embodiment, the stability can be improved under an environment in which temperature change occurs in a low temperature region.

Second Embodiment

Next, a second embodiment that embodies a method for preparing a dilute liquid of synthetic fiber treatment agent of the present invention (hereinafter referred to as "method for preparing a dilute liquid of treatment agent") will be described.

The method for preparing a dilute liquid of treatment agent of the present embodiment includes adding the first treatment agent-containing composition and the second treatment agent of the first embodiment to water such that the dilute liquid has a nonvolatile concentration of not less than 0.01% by mass and not more than 10% by mass. The term nonvolatile content as used herein refers to residue after sufficient removal of volatile substances by heat-treating an object at 105° C. for 2 hours, that is, to absolutely dry matter.

In the dilute liquid of treatment agent of the present embodiment, the first treatment agent-containing composition and the second treatment agent are mixed such that first treatment agent/second treatment agent is 20/80 to 80/20 (mass ratio). By using the first treatment agent and the second treatment agent in combination, the mixing ratio of the first treatment agent and the second treatment agent can be changed as desired. It is thus easy to prepare a treatment agent for always obtaining optimal spinning and drawing properties by finely adjusting the mixing ratio even if manufacturing conditions differ due to differences in manufacturing equipment or differences in climate such as temperature and humidity. Stable fiber production is thereby enabled.

A known method can be used as appropriate as a method for adding the first treatment agent-containing composition and the second treatment agent to water, and a first step described below and a second step described below are preferably undertaken. By such a method, if the mixture of the first treatment agent-containing composition and the second treatment agent is of emulsion form, the emulsion has further improved stability properties.

The first step is a step of adding the first treatment agent-containing composition and the second treatment agent to a first water to prepare a mother liquid of dilute liquid of synthetic fiber treatment agent with a nonvolatile concentration of more than 2% by mass but not more than 10% by mass. The order of addition of the first treatment agent-containing composition and the second treatment agent to the first water is not restricted in particular. The first treatment agent-containing composition may be added to the first water first, and then the second treatment agent may be added thereto. Alternatively, the second treatment agent may be added to the first water first, and then the first treatment agent-containing composition may be added thereto. Alternatively, the first treatment agent-containing composition and the second treatment agent may be added to the first water at the same time. From a standpoint of improvement of the stability properties of the emulsion, it is preferable to first add the first treatment agent-containing composition to the first water and then add the second treatment agent thereto. The temperature of the water for dilution is not restricted in particular.

The first step preferably further includes steps of warming water of not less than 20% by mass and not more than 70% by mass of the total amount of the first water to not less than 60° C. and not more than 95° C., adding thereto the first treatment agent-containing composition and the second treatment agent, and thereafter further adding thereto the remaining first water of not more than 40° C. By such a method, if the mixture of the first treatment agent-containing composition and the second treatment agent is of emulsion form, the emulsion has further improved stability properties. Even in this case, the order of addition of the first treatment agent-containing composition and the second treatment agent to the water is not restricted in particular. The first treatment agent-containing composition may be added to the water first, and then the second treatment agent may be added thereto. Alternatively, the second treatment agent may be added to the water first, and then the first treatment agent-containing composition may be added thereto. Alternatively, the first treatment agent-containing composition and the second treatment agent may be added to the water at the same time. From a standpoint of improvement of the stability properties of the emulsion, it is preferable to first add the first treatment agent-containing composition to the water and then add the second treatment agent thereto.

Alternatively, the first step may include steps of warming water of not less than 20% by mass and not more than 70% by mass of the total amount of the first water to not less than 60° C. and not more than 95° C., adding thereto the first treatment agent-containing composition, thereafter further adding thereto the remaining first water of not more than 40° C., and lastly further adding thereto the second treatment agent. By such a method, if the mixture of the first treatment agent-containing composition and the second treatment agent is of emulsion form, the emulsion has further improved stability properties.

The second step is a step of adding a second water to the dilute liquid of synthetic fiber treatment agent prepared in the first step to prepare a dilute liquid of synthetic fiber treatment agent with a nonvolatile concentration of not less than 0.01% by mass and not more than 2% by mass.

Effects of the method for preparing a dilute liquid of treatment agent of the embodiment will now be described.

(2-1) The method for preparing a dilute liquid of treatment agent of the embodiment includes adding the first treatment agent-containing composition and the second treatment agent at predetermined ratios to water such that the dilute liquid has a nonvolatile concentration of not less than 0.01% by mass and not more than 10% by mass. By such a method, if the mixture of the first treatment agent-containing composition and the second treatment agent is of emulsion form, the emulsion has improved stability properties. Also, since the dilute liquid, which is the form of application to fibers, can be prepared by mixing the first treatment agent-containing composition and the second treatment agent, which have been prepared in advance, with water, the dilute liquid can be prepared easily in comparison to a method of concocting from reagents at the time of use.

(2-2) If the step of adding the first treatment agent-containing composition and the second treatment agent to water to prepare a mother liquid of dilute liquid of synthetic fiber treatment agent with a nonvolatile concentration of more than 2% by mass but not more than 10% by mass is undertaken, the stability properties of the emulsion can be further improved. The effects due to the respective ingredients can thereby be exhibited effectively without degrading uniform adherability of the ingredients to a fiber.

Third Embodiment

Next, a third embodiment that embodies a method for treating synthetic fiber of the present invention will be described.

The method for treating synthetic fiber of the present embodiment includes applying, to a synthetic fiber, a dilute liquid of treatment agent obtained by adding the first treatment agent-containing composition and the second treatment agent to water, for example, in a spinning or drawing step or a finishing step. As the method for preparing the dilute liquid of treatment agent, the method for preparing a dilute liquid of treatment agent of the second embodiment can be adopted. Water content of the dilute liquid of treatment agent adhered to the synthetic fiber may be evaporated by a drying step.

The synthetic fiber to which the dilute liquid of treatment agent is applied is not particularly limited, and specific examples thereof include (1) a polyester fiber, such as polyethylene terephthalate (PET), polytrimethylene terephthalate, polybutylene terephthalate, polyethylene naphthalate, polylactic acid, or a composite fiber containing these polyester resins, (2) a polyamide fiber, such as nylon 6 or nylon 66, (3) a polyacrylic fiber, such as polyacrylic or modacrylic, and (4) a polyolefin fiber, such as polyethylene or polypropylene. Application to a polyester fiber or a polyolefin fiber among the above is preferable from a standpoint that the effect of uniformly applying the synthetic fiber treatment agent is exhibited excellently by improvement of wetting property.

Use of the synthetic fiber to which the dilute liquid of treatment agent is applied in the finishing process is not particularly restricted, and examples thereof include a short fiber, a spun yarn, and a nonwoven fabric. Applications as both short fiber use and long fiber use are possible and it is preferably applied to a short fiber. Short fibers correspond to those that are generally called staples and do not include long fibers that are generally called filaments. The length of the short fiber is not particularly restricted as long as it corresponds to that of short fiber in the art and, for example, is preferably not more than 100 mm.

The ratio of adhering the dilute liquid of treatment agent to the synthetic fiber is not particularly limited, and the dilute liquid of treatment agent is adhered such as to be of a ratio of 0.1% to 3% by mass (not including water or other solvent) with respect to the synthetic fiber. By such arrangement, the effects due to the respective ingredients can be exhibited effectively. The method for adhering the synthetic fiber treatment agent is not particularly limited, and a known method such as a roller oiling method, a guide oiling method using a metering pump, an immersion oiling method, or a spray oiling method can be used in accordance with type and form of the synthetic fiber.

Effects of the method for treating synthetic fiber of the present embodiment will now be described.

(3-1) The method for treating synthetic fiber of the present embodiment includes applying the dilute liquid of treatment agent to a synthetic fiber, for example, in a spinning or drawing step or a finishing step. Effects on a short fiber, a spun yarn, a nonwoven fabric due to the respective ingredients can thereby be exhibited effectively without degrading the uniform adherability of the respective ingredients to the synthetic fiber.

The above-described embodiments may be modified as follows. The above-described embodiments and modifications described below can be implemented upon being combined with each other within a range that is not technically inconsistent.

The first treatment agent, the second treatment agent, or the first treatment agent-containing composition of the above-described embodiments may further include a stabilizer, an antistatic agent, a binder, an antioxidant, an ultraviolet absorber, and other ingredients that are ordinarily used in treatment agents for quality maintenance of the respective agents within a range that does not impair the effects of the present invention.

EXAMPLES

Examples will now be given below to describe the features and effects of the present invention more specifically, but the present invention is not restricted to these examples. In the following description of working examples and comparative examples, parts means parts by mass and % means % by mass unless otherwise noted.

Experimental Part 1 (Preparation of First Treatment Agents)

(First Treatment Agent (I-1))

A first treatment agent (I-1) was prepared by a preparation method described below using the respective ingredients shown in Table 1.

The first treatment agent (I-1) that contains 99 parts (%) of potassium stearyl phosphoric acid ester (2.5) (A-1) as the organic phosphoric acid ester salt (A) and 1 part (%) of potassium butyl phosphoric acid ester salt (1.8) (B-1) as the organic phosphoric acid ester salt (B) was prepared.

(First Treatment Agents (I-2) to (I-12) and (rI-13) to (rI-15))

In the same manner as the first treatment agent (I-1), first treatment agents (I-2) to (I-12) and (rI-13) to (rI-15) were prepared by mixing the organic phosphoric acid ester salts (A) and organic phosphoric acid ester salts (B) at the ratios indicated in Table 1.

The types and contents of the organic phosphoric acid ester salts (A) and the types and contents of the organic phosphoric acid ester salts (B) are respectively indicated in the "Organic phosphoric acid ester salt (A)" column and the "Organic phosphoric acid ester salt (B)" column of Table 1.

(Acid Value)

The acid value in each first treatment agent was measured. The specific measurement method for acid value is as follows. The first treatment agent was sampled in a 100 ml beaker such that the mass of the first treatment agent is 2 g. 80 mL of an ethanol/xylene=½ solution were added thereto and stirring by a magnetic stirrer was performed. If dissolution is difficult, stirring was performed after warming the solvent in a hot water bath of 60° C., and measurement was performed after cooling to room temperature. The acid value was measured using a potentiometric titration device and using a 1/10 N KOH methanol solution. The acid value of the first treatment agent is indicated in the "Acid value measured from first treatment agent" column of Table 1.

TABLE 1

| Type of first treatment agent | Organic phosphoric acid ester salt (A) Type | Organic phosphoric acid ester salt (A) Content (%) | Organic phosphoric acid ester salt (B) Type | Organic phosphoric acid ester salt (B) Content (%) | Acid value measured from first treatment agent (mg KOH/g) | Amount of inorganic potassium phosphate in first treatment agent (%) |
|---|---|---|---|---|---|---|
| I-1 | A-1 | 99 | B-1 | 1 | 15 | 1.1 |
| I-2 | A-2 | 99 | B-2 | 1 | 10 | 2.1 |
| I-3 | A-3 | 80 | B-1 | 20 | 3 | 0.7 |
| I-4 | A-4 | 90 | B-3 | 10 | 15 | 3.1 |
| I-5 | A-5 | 95 | B-1 | 5 | 12 | 4.6 |
| I-6 | A-6 | 85 | B-4 | 15 | 10 | 4.2 |
| I-7 | A-7 | 80 | B-1 | 20 | 10 | 2 |
| I-8 | A-8 | 80 | B-5 | 20 | 13 | 3 |
| I-9 | A-9 | 90 | B-1 | 10 | 8 | 2.1 |
| I-10 | A-10 | 95 | B-6 | 5 | 13 | 1.2 |
| I-11 | A-1 | 90 | B-2 | 10 | 12 | 1 |
| I-12 | A-1 | 93 | B-1 | 7 | 17 | 1 |
| rI-13 | A-1 | 93 | B-1 | 7 | 27 | 1 |
| rI-14 | a-1 | 95 | B-2 | 5 | 15 | 0.9 |
| rI-15 | A-1 | 60 | B-1 | 40 | 15 | 2.9 |

Details of the organic phosphoric acid ester salts (A) and the organic phosphoric acid ester salts (B) indicated in Table 1 are as follows.

(Organic Phosphoric Acid Ester Salts (A))

A-1: potassium stearyl phosphoric acid ester (2.5)
A-2: potassium stearyl phosphoric acid ester (2.6)
A-3: potassium stearyl phosphoric acid ester (2.8)
A-4: potassium stearyl phosphoric acid ester (3.0)
A-5 potassium cetylstearyl (30:70) phosphoric acid ester (2.6)
A-6: potassium cetylstearyl (20:80) phosphoric acid ester (2.8)
A-7: potassium cetylstearyl (50:50) phosphoric acid ester (2.5)
A-8: potassium cetylstearyl (50:50) phosphoric acid ester (2.8)
A-9: potassium cetylstearyl (60:40) phosphoric acid ester (2.5)
A-10 potassium cetylstearyl (70:30) phosphoric acid ester (3.0)
a-1: potassium behenyl phosphoric acid ester (3.0)

(Organic Phosphoric Acid Ester Salts (B))

B-1: potassium butyl phosphoric acid ester (1.8)
B-2: potassium butyl phosphoric acid ester (2.5)
B-3: potassium hexyl phosphoric acid ester (2.0)
B-4: potassium hexyloctyl (50:50) phosphoric acid ester (1.8)
B-5: potassium 2-ethylhexyl phosphoric acid ester (2.6)
B-6: potassium octyl phosphoric acid ester (3.0)

Experimental Part 2 (Preparation of First Treatment Agent-Containing Compositions)

Example 1

A first treatment agent-containing composition (XI-1) was prepared by a preparation method described below using the respective ingredients shown in Table 2. The first treatment agent-containing composition (XI-1) of Example 1 that contains 40 parts (%) of the first treatment agent (I-1) and 60 parts (%) of water as the solvent (S) as shown in Table 2 was prepared.

Examples 2-12 and Comparative Examples 1 to 5

In the same manner as Example 1, Examples 2 to 12 (first treatment agent-containing compositions (XI-2) to (XI-12) and Comparative Examples 1 to 5 (first treatment agent-containing compositions (rXI-13) to (rXI-17) were prepared such as to contain the first treatment agents and the solvent (S) at the ratios indicated in Table 2. The types and contents of the first treatment agents and the type and contents of the solvent (S) are respectively indicated in the "First treatment agent" column and the "Solvent(S)" column of Table 2.

TABLE 2

| Type of first treatment agent-containing composition | | First treatment agent Type | First treatment agent Content (%) | Solvent (S) Type | Solvent (S) Content (%) | Evaluation: Stability at room temperature | Evaluation: Stability under temperature change | Evaluation: Handleability |
|---|---|---|---|---|---|---|---|---|
| Example 1 | XI-1 | I-1 | 40 | Water | 60 | ◎ | ◎ | ◎ |
| Example 2 | XI-2 | I-2 | 40 | Water | 60 | ◎ | ◎ | ◎ |
| Example 3 | XI-3 | I-3 | 40 | Water | 60 | ◎ | ◎ | ◎ |
| Example 4 | XI-4 | I-4 | 40 | Water | 60 | ◎ | ◎ | ◎ |
| Example 5 | XI-5 | I-5 | 40 | Water | 60 | ◎ | ◎ | ◎ |
| Example 6 | XI-6 | I-6 | 40 | Water | 60 | ◎ | ◎ | ◎ |
| Example 7 | XI-7 | I-7 | 40 | Water | 60 | ◎ | ◎ | ◎ |
| Example 8 | XI-8 | I-8 | 40 | Water | 60 | ◎ | ◎ | ◎ |
| Example 9 | XI-9 | I-9 | 50 | Water | 50 | ◎ | ◎ | ◎ |
| Example 10 | XI-10 | I-10 | 35 | Water | 65 | ◎ | ◎ | ◎ |
| Example 11 | XI-11 | I-1 | 45 | Water | 55 | ◎ | ◎ | ◎ |
| Example 12 | XI-12 | I-12 | 40 | Water | 60 | ◎ | ○ | ○ |
| Comparative example 1 | rXI-13 | rI-13 | 40 | Water | 60 | ◎ | X | X |
| Comparative example 2 | rXI-14 | rI-14 | 40 | Water | 60 | ◎ | ◎ | X |
| Comparative example 3 | rXI-15 | rI-15 | 40 | Water | 60 | ◎ | X | ◎ |
| Comparative example 4 | rXI-16 | I-1 | 25 | Water | 75 | X | X | ◎ |
| Comparative example 5 | rXI-17 | I-1 | 65 | Water | 35 | ◎ | ◎ | X |

Experimental Part 3 (Preparation of Second Treatment Agents)

(Second Treatment Agent (II-1))

A second treatment agent (II-1) was prepared by a preparation method described below using the respective ingredients shown in Table 3.

The second treatment agent (II-1) constituted of a composition 1 was prepared by mixing well and making uniform 65 parts (%) of (polyoxyethylene) (polyoxypropylene) (m=6, n=2, m is the number of oxyethylene units (the same applies hereinafter), n is the number of oxypropylene units (the same applies hereinafter), random polymer) C12-C13 alkyl ether (C-4), 22 parts (%) of polyoxyethylene (10 moles) coconut alkylamine ether (C-25), and 13 parts (%) of polyoxyethylene (15 moles) coconut alkylamine ether (C-25) as the nonionic surfactants (C).

The method for denoting (polyoxyethylene) (polyoxypropylene) in the nonionic surfactant expresses the order of addition in the case of a block polymer and with (polyoxyethylene) (polyoxypropylene), a form in which ethylene oxide is added and propylene oxide is added thereafter is signified (the same applies hereinafter).

(Second Treatment Agents (II-2) to (II-27))

In the same manner as the second treatment agent (II-1), second treatment agents (II-2) to (II-27) were prepared by mixing the nonionic surfactants (C) and other ingredients (D) at the ratios indicated in Tables 3 and 4.

The types and contents of the nonionic surfactants (C) and the types and contents of the other ingredients (D) are respectively indicated in the "Nonionic surfactant (C)" rows and the "Other ingredient (D)" rows of Tables 3 and 4.

TABLE 3

| Type of second treatment agent | | II-1 Composition 1 | II-2 Composition 2 | II-3 Composition 3 | II-4 Composition 4 | II-5 Composition 5 | II-6 Composition 6 | II-7 Composition 7 | II-8 Composition 8 | II-9 Composition 9 | II-10 Composition 10 | II-11 Composition 11 | II-12 Composition 12 | II-13 Composition 13 |
|---|---|---|---|---|---|---|---|---|---|---|---|---|---|---|
| Nonionic surfactant (C) | C-1 | | | | | | | | | | | | | |
| | C-2 | | 50 | 30 | 30 | | | | | 30 | 28 | 30 | | 65 |
| | C-3 | | | | | | | | | | | | | |
| | C-4 | 65 | 50 | 30 | 30 | 30 | 30 | 30 | 30 | 30 | 28 | 5 | | |
| | C-5 | | | | | | | | | | | | | |
| | C-6 | | | | | | | | | | | | | |
| | C-7 | | | | | | | | | | | | | |
| | C-8 | | | | | | | | | | | | 28 | |
| | C-9 | | | | | | | | | | | | | |
| | C-10 | | | | | | | | | | | | | |
| | C-11 | | | | | | | | | | | | | |
| | C-12 | | | | | | | | | | | | | 35 |
| | C-13 | | | | | | | | | | | | | |
| | C-14 | | | | | 30 | 30 | 30 | 30 | | | 25 | 28 | |
| | C-15 | | | | | | | | | | | | | |
| | C-16 | | | 40 | | | 40 | | | 31 | 36 | 24 | 36 | |
| | C-17 | | | | 40 | 40 | | | 32 | | | | | |
| | C-18 | | | | | | | | | | | | | |
| | C-19 | | | | | | | | | | | | | |

TABLE 3-continued

| Type of second treatment agent | | II-1 Composition 1 | II-2 Composition 2 | II-3 Composition 3 | II-4 Composition 4 | II-5 Composition 5 | II-6 Composition 6 | II-7 Composition 7 | II-8 Composition 8 | II-9 Composition 9 | II-10 Composition 10 | II-11 Composition 11 | II-12 Composition 12 | II-13 Composition 13 |
|---|---|---|---|---|---|---|---|---|---|---|---|---|---|---|
| | C-20 | | | | | | | | | | | | | |
| | C-21 | | | | | | | | | | | | | |
| | C-22 | | | | | | | | | | | | | |
| | C-23 | | | | | | | | | | | | | |
| | C-24 | | | | | | | | | | | | | |
| | C-25 | 22 | | | | | | 40 | | | | 16 | | |
| | C-26 | | | | | | | | | | | | | |
| | C-27 | 13 | | | | | | | | | | | | |
| | C-28 | | | | | | | | | | | | | |
| | C-29 | | | | | | | | 8 | | | | | |
| | C-30 | | | | | | | | | | 8 | | | |
| | C-31 | | | | | | | | | | | | 8 | |
| | C-32 | | | | | | | | | 9 | | | | |
| Other ingredient (D) | D-1 | | | | | | | | | | | | | |
| | D-2 | | | | | | | | | | | | | |
| | D-3 | | | | | | | | | | | | | |
| | D-4 | | | | | | | | | | | | | |
| Total 100 parts (%) | | 100 | 100 | 100 | 100 | 100 | 100 | 100 | 100 | 100 | 100 | 100 | 100 | 100 |

TABLE 4

| Type of second treatment agent | | II-14 Composition 14 | II-15 Composition 15 | II-16 Composition 16 | II-17 Composition 17 | II-18 Composition 18 | II-19 Composition 19 | II-20 Composition 20 | II-21 Composition 21 | II-22 Composition 22 | II-23 Composition 23 | II-24 Composition 24 | II-25 Composition 25 | II-26 Composition 26 | II-27 Composition 27 |
|---|---|---|---|---|---|---|---|---|---|---|---|---|---|---|---|
| Non-ionic surfactant (C) | C-1 | | | 30 | | | | | | | | | | | |
| | C-2 | 45 | | | | | | | | | | | | | |
| | C-3 | | 50 | | | | | | | | | | | | |
| | C-4 | | | | | | | | 5 | | | | | | |
| | C-5 | | | | | | | | | | | | | | |
| | C-6 | | 20 | | | | | | | | | | | | |
| | C-7 | | | | | | | | | 46 | | | | | |
| | C-8 | | | | | 59 | | | | | | | | | |
| | C-9 | | | | | | 30 | | | | | | | | |
| | C-10 | 20 | | | | | | | 30 | | | | | | |
| | C-11 | | | | | | | | | | 65 | | | | |
| | C-12 | | | | | | | 100 | | | | | | | 25 |
| | C-13 | | | | | | | | | | | | | | |
| | C-14 | 19.5 | | 20 | | | 32 | | 10 | | | | | 50 | |
| | C-15 | | | | | | | | | | | | | | 25 |
| | C-16 | | | | | | 38 | | | | | | | | 50 |
| | C-17 | | | | 100 | | | | | | | | | 40 | |
| | C-18 | 15 | | 50 | | | | | 45 | | | | | | |
| | C-19 | | | | | | | | | | | | | | |
| | C-20 | | | | | | | | | 54 | | | | | |
| | C-21 | | 29 | | | | | | | | | | | | |
| | C-22 | | | | | | | | | | | | 100 | | |
| | C-23 | | | | | | | | | | | | | | |
| | C-24 | | | | | | | | | | | 95 | | | |
| | C-25 | | | | | | | | | | | | | | |
| | C-26 | | | | | | | | | | | | | | |
| | C-27 | | | | | 31 | | | | | 35 | | | | |
| | C-28 | | | | | | | | | | | | | | |
| | C-29 | | | | | | | | | | | | | | |
| | C-30 | | | | | | | | | | | | | | |
| | C-31 | | | | | | | | | | | | | | |
| | C-32 | | | | | | | | | | | | | | |
| Other ingredient (D) | D-1 | | | | | 10 | | | 10 | | | | | | |
| | D-2 | | | | | | | | | | | 5 | | 10 | |
| | D-3 | 0.5 | | | | | | | | | | | | | |
| | D-4 | | 1 | | | | | | | | | | | | |
| Total 100 parts (%) | | 100 | 100 | 100 | 100 | 100 | 100 | 100 | 100 | 100 | 100 | 100 | 100 | 100 | 100 |

Details of the nonionic surfactants (C) and the other ingredients (D) indicated in Tables 3 and 4 are as follows.

(Nonionic Surfactants (C))

C-1: (polyoxyethylene) (polyoxypropylene) (m=2, n=5, block polymer) decyl ether

C-2: polyoxyethylene (10 moles: represents the added number of moles of alkylene oxide (the same applies hereinafter)) C12-C13 alkyl ether C-3: polyoxyethylene (15 moles) C12-C13 alkyl ether C-4: (polyoxyethylene) (polyoxypropylene) (m=6, n=2, random polymer) C12-C13 alkyl ether C-5: polyoxyethylene (10 moles) C11-C14 alkyl ether C-6: polyoxyethylene (15 moles) tridecyl ether C-7: (polyoxyethylene) (polyoxypropylene) (m=7, n=5, block polymer) C11-C14 alkyl ether C-8: (polyoxyethylene) (polyoxypropylene) (m=6, n=2, random polymer) tridecyl ether C-9: (polyoxyethylene) (polyoxypropylene) (m=5, n=5, block polymer) isodecyl ether C-10: (polyoxypropylene) (polyoxyethylene) (m=2, n=5, block polymer) isodecyl ether C-11: (polyoxyethylene) (polyoxypropylene) (m=5, n=5, block polymer) isotridecyl ether C-12: polyoxyethylene (10 moles) dodecyl ether C-13: polyoxyethylene (15 moles) dodecyl ether C-14: polyoxyethylene (9 moles) dodecyl ether C-15: (polyoxyethylene) (polyoxypropylene) (m=5, n=5, block polymer) dodecyl ether C-16: polyoxyethylene (10 moles) dodecylamine ether C-17: salt of polyoxyethylene (10 moles) dodecylamine ether and phosphoric acid C-18: polyoxyethylene (15 moles) dodecylamine ether C-19: polyoxyethylene (4 moles) dodecylamine ether C-20: polyoxyethylene (10 moles) octadecyl ether C-21: polyoxyethylene (10 moles) octadecylamine ether C-22: polyoxyethylene (10 moles) lauryl ester C-23: polyoxyethylene (7 moles) coconut fatty acid ester C-24: polyoxyethylene (10 moles) coconut fatty acid ester C-25: polyoxyethylene (10 moles) coconut alkylamine ether C-26: polyoxyethylene (12 moles) coconut alkylamine ether C-27: polyoxyethylene (15 moles) coconut alkylamine ether C-28: polyoxyethylene (10 moles) oleyl ester C-29: (polyoxypropylene) (polyoxyethylene) (block addition) propylene glycol ether (average molecular weight: 3000; polyoxyethylene addition rate: 90% by mole)

C-30: (polyoxypropylene) (polyoxyethylene) (block addition) propylene glycol ether (average molecular weight: 6000; polyoxyethylene addition rate: 80% by mole)

C-31: (polyoxypropylene) (polyoxyethylene) (block addition) diglycerin ether (average molecular weight: 3000; polyoxyethylene addition rate: 65% by mole)

C-32: polyoxypropylene polyoxyethylene (random addition) diglycerin ether (average molecular weight: 6000; polyoxyethylene addition rate: 90% by mole)

(Other Ingredients (D))

D-1: potassium oleate

D-2: potassium laurate

D-3: potassium lactate

D-4: potassium acetate

Experimental Part 4 (Preparation of Synthetic Fiber Treatment Agents 1)

The first treatment agent-containing compositions obtained in Experimental Part 2 and the second treatment agents obtained in Experimental Part 3 were mixed by a method described below at the ratios indicated in Table 5 to ultimately prepare dilute liquids of synthetic fiber treatment agent of emulsion form.

Example 13

First, 40 g of cation exchanged water were weighed out and stirred for 3 minutes using a propeller stirrer at 500 rpm in a hot water bath of 80° C. 5.0 g (2.0 g as nonvolatile content) of the first treatment agent-containing composition (XI-8) were dripped into the beaker with a dropper and stirring was performed for 5 minutes.

Next, 2.0 g (2.0 g as nonvolatile content) of the second treatment agent (II-21) were dripped in using a dropper and stirring was performed for 5 minutes.

The blending ratio (%) of the first treatment agent at this point is: mass of first treatment agent/(mass of first treatment agent+mass of second treatment agent)×100=50(%). The blending ratio (%) of the second treatment agent is: mass of second treatment agent/(mass of first treatment agent+mass of second treatment agent)×100=50(%).

The beaker was taken out of the hot water bath and 33 g (adjusted as appropriate such as to be [80 (g)-40 (g)—"total (g) of added amount of the first treatment agent-containing composition and the second treatment agent"]) of cation exchanged water of 25° C. were added under stirring at 500 rpm at room temperature. After stirring for 3 minutes, cation exchanged water was added such that a total mass of the dilute liquid would be 80 g. The dilute liquid obtained upon stirring for 1 minute was used as a 5% dilute liquid (nonvolatile content: 5%) that is a dilute liquid of synthetic fiber treatment agent of Example 13.

Examples 14 to 73

For Examples 14 to 73, 5% emulsions were prepared as dilute liquids of synthetic fiber treatment agent by mixing the first treatment agents and the second treatment agents in the same manner as Example 13 at the ratios indicated in Table 5.

The types and contents of the first treatment agents and the types and contents of the second treatment agents are respectively indicated in the "First treatment agent" column and the "Second treatment agent" column of Table 5.

TABLE 5

| | First treatment agent | | Second treatment agent | | Evaluation | | |
|---|---|---|---|---|---|---|---|
| Category | Type | Content (%) | Type | Content (%) | Card passing property | Drawing property | Generated electricity |
| Example 13 | I-8 | 50 | II-21 | 50 | ◎ | ◎ | ◎ |
| Example 14 | I-10 | 50 | II-17 | 50 | ◎ | ◎ | ◎ |
| Example 15 | I-4 | 50 | II-18 | 50 | ◎ | ◎ | ◎ |
| Example 16 | I-2 | 50 | II-19 | 50 | ◎ | ◎ | ◎ |

TABLE 5-continued

| | First treatment agent | | Second treatment agent | | Evaluation | | |
|---|---|---|---|---|---|---|---|
| Category | Type | Content (%) | Type | Content (%) | Card passing property | Drawing property | Generated electricity |
| Example 17 | I-5 | 50 | II-20 | 50 | ◎ | ◎ | ◎ |
| Example 18 | I-9 | 50 | II-21 | 50 | ◎ | ◎ | ◎ |
| Example 19 | I-4 | 50 | II-22 | 50 | ◎ | ◎ | ◎ |
| Example 20 | I-6 | 50 | II-23 | 50 | ◎ | ◎ | ◎ |
| Example 21 | I-2 | 50 | II-24 | 50 | ◎ | ◎ | ◎ |
| Example 22 | I-12 | 60 | II-25 | 40 | ◎ | ◎ | ◎ |
| Example 23 | I-3 | 60 | II-26 | 40 | ◎ | ◎ | ◎ |
| Example 24 | I-8 | 60 | II-27 | 40 | ◎ | ◎ | ◎ |
| Example 25 | I-7 | 60 | II-26 | 40 | ◎ | ◎ | ◎ |
| Example 26 | I-5 | 60 | II-25 | 40 | ◎ | ◎ | ◎ |
| Example 27 | I-1 | 60 | II-24 | 40 | ◎ | ◎ | ◎ |
| Example 28 | I-10 | 60 | II-23 | 40 | ◎ | ◎ | ◎ |
| Example 29 | I-4 | 60 | II-22 | 40 | ◎ | ◎ | ◎ |
| Example 30 | I-3 | 60 | II-21 | 40 | ◎ | ◎ | ◎ |
| Example 31 | I-7 | 70 | II-20 | 30 | ◎ | ◎ | ◎ |
| Example 32 | I-8 | 70 | II-21 | 30 | ◎ | ◎ | ◎ |
| Example 33 | I-2 | 70 | II-22 | 30 | ◎ | ◎ | ◎ |
| Example 34 | I-5 | 70 | II-23 | 30 | ◎ | ◎ | ◎ |
| Example 35 | I-7 | 70 | II-24 | 30 | ◎ | ◎ | ◎ |
| Example 36 | I-1 | 70 | II-25 | 30 | ◎ | ◎ | ◎ |
| Example 37 | I-6 | 70 | II-26 | 30 | ◎ | ◎ | ◎ |
| Example 38 | I-12 | 70 | II-27 | 30 | ◎ | ◎ | ◎ |
| Example 39 | I-6 | 80 | II-1 | 20 | ◎ | ◎ | ◎ |
| Example 40 | I-2 | 80 | II-2 | 20 | ◎ | ◎ | ◎ |
| Example 41 | I-3 | 80 | II-3 | 20 | ◎ | ◎ | ◎ |
| Example 42 | I-9 | 80 | II-4 | 20 | ◎ | ◎ | ◎ |
| Example 43 | I-12 | 80 | II-5 | 20 | ◎ | ◎ | ◎ |
| Example 44 | I-5 | 80 | II-6 | 20 | ◎ | ◎ | ◎ |
| Example 45 | I-7 | 80 | II-7 | 20 | ◎ | ◎ | ◎ |
| Example 46 | I-8 | 50 | II-8 | 50 | ◎ | ◎ | ◎ |
| Example 47 | I-3 | 60 | II-9 | 40 | ◎ | ◎ | ◎ |
| Example 48 | I-1 | 70 | II-10 | 30 | ◎ | ◎ | ◎ |
| Example 49 | I-6 | 80 | II-11 | 20 | ◎ | ◎ | ◎ |
| Example 50 | I-9 | 50 | II-12 | 50 | ◎ | ◎ | ◎ |
| Example 51 | I-2 | 60 | II-13 | 40 | ◎ | ◎ | ◎ |
| Example 52 | I-4 | 70 | II-14 | 30 | ◎ | ◎ | ◎ |
| Example 53 | I-5 | 80 | II-15 | 20 | ◎ | ◎ | ◎ |
| Example 54 | I-8 | 50 | II-16 | 50 | ◎ | ◎ | ◎ |
| Example 55 | I-3 | 60 | II-17 | 40 | ◎ | ◎ | ◎ |
| Example 56 | I-6 | 70 | II-18 | 30 | ◎ | ◎ | ◎ |
| Example 57 | I-11 | 80 | II-19 | 20 | ◎ | ◎ | ◎ |
| Example 58 | I-1 | 30 | II-1 | 70 | ◎ | ◎ | ◎ |
| Example 59 | I-2 | 30 | II-2 | 70 | ◎ | ◎ | ◎ |
| Example 60 | I-3 | 30 | II-3 | 70 | ◎ | ◎ | ◎ |
| Example 61 | I-4 | 30 | II-4 | 70 | ◎ | ◎ | ◎ |
| Example 62 | I-5 | 30 | II-5 | 70 | ◎ | ◎ | ◎ |
| Example 63 | I-6 | 30 | II-6 | 70 | ◎ | ◎ | ◎ |
| Example 64 | I-7 | 30 | II-7 | 70 | ◎ | ◎ | ◎ |
| Example 65 | I-8 | 30 | II-8 | 70 | ◎ | ◎ | ◎ |
| Example 66 | I-9 | 40 | II-9 | 60 | ◎ | ◎ | ◎ |
| Example 67 | I-10 | 40 | II-10 | 60 | ◎ | ◎ | ◎ |
| Example 68 | I-11 | 40 | II-11 | 60 | ◎ | ◎ | ◎ |
| Example 69 | I-7 | 40 | II-12 | 60 | ◎ | ◎ | ◎ |
| Example 70 | I-9 | 40 | II-13 | 60 | ◎ | ◎ | ◎ |
| Example 71 | I-1 | 40 | II-14 | 60 | ◎ | ◎ | ◎ |
| Example 72 | I-9 | 40 | II-15 | 60 | ◎ | ◎ | ◎ |
| Example 73 | I-4 | 40 | II-16 | 60 | ◎ | ◎ | ◎ |

Experimental Part 5 (Preparation of Synthetic Fiber Treatment Agents 2)

Synthetic fiber treatment agents were obtained by mixing the respective ingredients shown in Table 6 at predetermined ratios without undergoing steps of preparing the first treatment agent and the second treatment agent.

Comparative Example 6

A synthetic fiber treatment agent of Comparative Example 6 was prepared such as to contain 49.5 parts of potassium stearyl phosphoric acid ester (2.5) (A-1) as the organic phosphoric acid ester salt (A), 0.5 parts of potassium butyl phosphoric acid ester (1.8) (B-1) as the organic phosphoric acid ester salt (B), 50 parts of the composition 1 shown in Table 3 as a surfactant, and 150 parts of water as the solvent (S) as shown in Table 6.

Comparative Examples 7 to 53

In the same manner as the synthetic fiber treatment agent of Comparative Example 6, synthetic fiber treatment agents of Comparative Examples 7 to 53 were prepared such as to contain the organic phosphoric acid ester salts (A), the organic phosphoric acid ester salts (B), the surfactants, and the solvent (S) at the ratios indicated in Table 6.

The types and contents of the organic phosphoric acid ester salts (A), the types and contents of the organic phosphoric acid ester salts (B), the types and contents of the surfactants, and the type and contents of the solvent (S) are respectively indicated in the "Organic phosphoric acid ester salt (A)" column, the "Organic phosphoric acid ester salt (B)" column, the "Surfactant" column, and the "Solvent(S)" column of Table 6. Also, concentrations of nonvolatile contents in the respective synthetic fiber treatment agents are indicated in the "Nonvolatile concentration" column.

TABLE 6

| | Nonvolatile content | | | | | | | | | Evaluation | | | | |
|---|---|---|---|---|---|---|---|---|---|---|---|---|---|---|
| | Organic phosphoric acid ester salt (A) | | Organic phosphoric acid ester salt (B) | | Surfactant | | Solvent (S) | | Nonvolatile | Stability | Stability under | | | |
| Type | Type | Parts by mass | Type | Parts by mass | Type | Parts by mass | Type | Parts by mass | concen-tration (%) | at room temper-ature | temper-ature change | Card passing property | Drawing property | Generated electricity |
| Comparative example 6 | A-1 | 49.5 | B-1 | 0.5 | Compo-sition 1 | 50 | Water | 150 | 40 | X | X | — | — | — |
| Comparative example 7 | A-2 | 49.5 | B-2 | 0.5 | Compo-sition 1 | 50 | Water | 150 | 40 | X | X | — | — | — |
| Comparative example 8 | A-3 | 40 | B-1 | 10 | Compo-sition 1 | 50 | Water | 150 | 40 | X | X | — | — | — |
| Comparative example 9 | A-4 | 45 | B-3 | 5 | Compo-sition 1 | 50 | Water | 150 | 40 | X | X | — | — | — |
| Comparative example 10 | A-5 | 47.5 | B-1 | 2.5 | Compo-sition 1 | 50 | Water | 150 | 40 | X | X | — | — | — |
| Comparative example 11 | A-6 | 42.5 | B-4 | 7.5 | Compo-sition 1 | 50 | Water | 150 | 40 | X | X | — | — | — |
| Comparative example 12 | A-7 | 40 | B-1 | 10 | Compo-sition 1 | 50 | Water | 150 | 40 | X | X | — | — | — |
| Comparative example 13 | A-8 | 40 | B-5 | 10 | Compo-sition 1 | 50 | Water | 150 | 40 | X | X | — | — | — |
| Comparative example 14 | A-9 | 45 | B-1 | 5 | Compo-sition 1 | 50 | Water | 150 | 40 | X | X | — | — | — |
| Comparative example 15 | A-10 | 47.5 | B-6 | 2.5 | Compo-sition 1 | 50 | Water | 233 | 30 | X | X | — | — | — |
| Comparative example 16 | A-1 | 45 | B-2 | 5 | Compo-sition 1 | 50 | Water | 150 | 40 | X | X | — | — | — |
| Comparative example 17 | A-1 | 48.5 | B-1 | 1.5 | Compo-sition 1 | 50 | Water | 150 | 40 | X | X | — | — | — |
| Comparative example 18 | A-1 | 45 | B-1 | 5 | Compo-sition 2 | 50 | Water | 150 | 40 | X | X | — | — | — |
| Comparative example 19 | A-1 | 45 | B-1 | 5 | Compo-sition 3 | 50 | Water | 150 | 40 | X | X | — | — | — |
| Comparative example 20 | A-1 | 45 | B-1 | 5 | Compo-sition 4 | 50 | Water | 150 | 40 | X | X | — | — | — |
| Comparative example 21 | A-1 | 45 | B-1 | 5 | Compo-sition 5 | 50 | Water | 186 | 35 | X | X | — | — | — |
| Comparative example 22 | A-1 | 45 | B-1 | 5 | Compo-sition 6 | 50 | Water | 150 | 40 | X | X | — | — | — |
| Comparative example 23 | A-1 | 45 | B-1 | 5 | Compo-sition 7 | 50 | Water | 150 | 40 | X | X | — | — | — |
| Comparative example 24 | A-1 | 45 | B-1 | 5 | Compo-sition 8 | 50 | Water | 122 | 45 | X | X | — | — | — |
| Comparative example 25 | A-1 | 45 | B-1 | 5 | Compo-sition 9 | 50 | Water | 150 | 40 | X | X | — | — | — |
| Comparative example 26 | A-1 | 45 | B-1 | 5 | Compo-sition 10 | 50 | Water | 122 | 45 | X | X | — | — | — |
| Comparative example 27 | A-1 | 45 | B-1 | 5 | Compo-sition 11 | 50 | Water | 150 | 40 | X | X | — | — | — |
| Comparative example 28 | A-1 | 45 | B-1 | 5 | Compo-sition 12 | 50 | Water | 150 | 40 | X | X | — | — | — |
| Comparative example 29 | A-1 | 45 | B-1 | 5 | Compo-sition 13 | 50 | Water | 150 | 40 | X | X | — | — | — |
| Comparative example 30 | A-1 | 45 | B-1 | 5 | Compo-sition 14 | 50 | Water | 150 | 40 | X | X | — | — | — |
| Comparative example 31 | A-1 | 45 | B-1 | 5 | Compo-sition 15 | 50 | Water | 150 | 40 | X | X | — | — | — |
| Comparative example 32 | A-1 | 45 | B-1 | 5 | Compo-sition 16 | 50 | Water | 100 | 50 | X | X | — | — | — |
| Comparative example 33 | A-1 | 45 | B-1 | 5 | Compo-sition 17 | 50 | Water | 150 | 40 | X | X | — | — | — |
| Comparative example 34 | A-1 | 45 | B-1 | 5 | Compo-sition 18 | 50 | Water | 150 | 40 | X | X | — | — | — |
| Comparative example 35 | A-1 | 45 | B-1 | 5 | Compo-sition 19 | 50 | Water | 150 | 40 | X | X | — | — | — |

TABLE 6-continued

| | Nonvolatile content | | | | | | | | | Evaluation | | | | |
|---|---|---|---|---|---|---|---|---|---|---|---|---|---|---|
| | Organic phosphoric acid ester salt (A) | | Organic phosphoric acid ester salt (B) | | Surfactant | | Solvent (S) | | Nonvolatile | Stability | Stability under | | | |
| Type | Type | Parts by mass | Type | Parts by mass | Type | Parts by mass | Type | Parts by mass | concen-tration (%) | at room temper-ature | temper-ature change | Card passing property | Drawing property | Generated electricity |
| Comparative example 36 | A-1 | 45 | B-1 | 5 | Compo-sition 20 | 50 | Water | 150 | 40 | X | X | — | — | — |
| Comparative example 37 | A-1 | 45 | B-1 | 5 | Compo-sition 21 | 50 | Water | 150 | 40 | X | X | — | — | — |
| Comparative example 38 | A-1 | 45 | B-1 | 5 | Compo-sition 22 | 50 | Water | 150 | 40 | X | X | — | — | — |
| Comparative example 39 | A-1 | 45 | B-1 | 5 | Compo-sition 23 | 50 | Water | 150 | 40 | X | X | — | — | — |
| Comparative example 40 | A-1 | 45 | B-1 | 5 | Compo-sition 24 | 50 | Water | 150 | 40 | X | X | — | — | — |
| Comparative example 41 | A-1 | 45 | B-1 | 5 | Compo-sition 25 | 50 | Water | 150 | 40 | X | X | — | — | — |
| Comparative example 42 | A-1 | 45 | B-1 | 5 | Compo-sition 26 | 50 | Water | 150 | 40 | X | X | — | — | — |
| Comparative example 43 | A-1 | 45 | B-1 | 5 | Compo-sition 27 | 50 | Water | 150 | 40 | X | X | — | — | — |
| Comparative example 44 | A-1 | 9.9 | B-1 | 0.1 | Compo-sition 1 | 90 | Water | 186 | 35 | X | X | — | — | — |
| Comparative example 45 | A-1 | 19.8 | B-1 | 0.2 | Compo-sition 1 | 80 | Water | 150 | 40 | X | X | — | — | — |
| Comparative example 46 | A-1 | 29.7 | B-1 | 0.3 | Compo-sition 1 | 70 | Water | 150 | 40 | X | X | — | — | — |
| Comparative example 47 | A-1 | 39.6 | B-1 | 0.4 | Compo-sition 1 | 60 | Water | 100 | 50 | X | X | — | — | — |
| Comparative example 48 | A-1 | 49.5 | B-1 | 0.5 | Compo-sition 1 | 50 | Water | 150 | 40 | X | X | — | — | — |
| Comparative example 49 | A-1 | 59.4 | B-1 | 0.6 | Compo-sition 1 | 40 | Water | 150 | 40 | X | X | — | — | — |
| Comparative example 50 | A-1 | 69.3 | B-1 | 0.7 | Compo-sition 1 | 30 | Water | 18 | 85 | X | X | — | — | — |
| Comparative example 51 | A-1 | 79.2 | B-1 | 0.8 | Compo-sition 1 | 20 | Water | 400 | 20 | X | X | — | — | — |
| Comparative example 52 | A-1 | 89.1 | B-1 | 0.9 | Compo-sition 1 | 10 | Water | 150 | 40 | X | X | — | — | — |
| Comparative example 53 | A-6 | 69.75 | B-4 | 5.25 | Compo-sition 27 | 25 | Water | 150 | 40 | X | X | — | — | — |

Experimental Part 6 (Evaluation of Stability at Room Temperature)

With each of the first treatment agent-containing compositions of Examples 1 to 12 and Comparative Examples 1 to 5 and the synthetic fiber treatment agents of Comparative Examples 6 to 53, 150 g were placed in a 250 mL transparent plastic bottle. After leaving still for 4 weeks under conditions of 25° C.×65% RH, the stability at room temperature was evaluated visually according to criteria given below. Results are indicated in the "Stability at room temperature" columns of Tables 2 and 6.

Evaluation Criteria of Stability at Room Temperature

◎ (satisfactory): Separation did not occur after elapse of 4 weeks.

x (poor): Separation occurred after elapse of 4 weeks.

Experimental Part 7 (Evaluation of Stability Under Temperature Change)

With each of Examples 1 to 12 and Comparative Examples 1 to 5 and each of Comparative Examples 6 to 53, the first treatment agent-containing composition or the synthetic fiber treatment agent was placed in a 250 mL transparent plastic bottle. Using a programmable thermostat, the stability under temperature change at low temperatures was evaluated with a cycle described below. The stability under temperature change was evaluated visually according to criteria given below. Results are indicated in the "Stability under temperature change" columns of Tables 2 and 6.

(1) 12 hours at 0° C., (2) 12 hours at 20° C., (3) the aforementioned (1) and (2) are carried out a total of 4 times each.

Evaluation Criteria of Stability Under Temperature Change

◎ (satisfactory): Neither separation nor thickening occurred.

○ (fair): Separation did not occur but thickening occurred.

x (poor): Separation occurred.

Experimental Part 8 (Evaluation of Handleability)

With each of the first treatment agent-containing compositions of Examples 1 to 12 and Comparative Examples 1 to 5, 50 g were placed in a transparent plastic bottle of 100 mL. After performing moisture conditioning for 1 month under conditions of 25° C.×40% RH, handleability was evaluated from a property of the composition. Results are indicated in the "Handleability" column of Table 2.

Evaluation Criteria of Handleability

◎ (satisfactory): Liquid flowed immediately upon tilting the plastic bottle by 90°.

○ (fair): Liquid flowed within 5 minutes from tilting the plastic bottle by 90°.

x (poor): There was no change in liquid surface (liquid did not begin to flow) within 5 minutes from tilting the plastic bottle by 90°.

Experimental Part 9 (Adhesion of Dilute Liquid of Treatment Agent to Polyester Staple Fibers)

The dilute liquid of synthetic fiber treatment agent of each example obtained in Experimental Part 4 was diluted further to prepare a 0.5% emulsion of synthetic fiber treatment agent. The prepared 0.5% emulsion was adhered by a spraying method such that an adhered amount as nonvolatile content would be 0.15% onto semi dull polyester staple fibers with a fineness of $1.3\times10^{-4}$ g/m (1.2 denier) and a fiber length of 38 mm obtained in a drafts making step. After then drying for 2 hours with a hot air dryer at 80° C., overnight moisture conditioning under an atmosphere of 25° C.×40% RH was performed to obtain treated polyester staple fibers. Comparative Examples 6 to 53 were evaluated to be poor in stability as indicated in Table 6 and were thus not evaluated for respective yarn spinning characteristics described below.

Experimental Part 10 (Evaluation of Card Passing Property)

20 g of the treated polyester staple fibers obtained in Experimental Part 9 were moisture conditioned for 24 hours inside a thermostatic chamber of 20° C. and 65% RH and thereafter fed to a miniature carding machine. The ratio of an amount discharged with respect to a loading amount was calculated and evaluated according to evaluation criteria given below. The results are shown in the "Card passing property" column of Table 5.

Evaluation Criteria of Card Passing Property

◎ (satisfactory): The discharged amount was not less than 90%.

○ (fair): The discharged amount was not less than 80% but less than 90%.

x (poor): The discharged amount was less than 80%.

Experimental Part 11 (Evaluation of Drawing Property)

Drawing property was evaluated as follows using a friction testing device shown schematically in FIG. 1.

The dilute liquid of synthetic fiber treatment agent of each example obtained in Experimental Part 4 was diluted further to prepare a 1% emulsion of synthetic fiber treatment agent.

The drawing property was evaluated as follows using the friction testing device 10 shown in FIG. 1. With each example, the interior of a container 11 of predetermined size was filled with the 1% emulsion 12 of synthetic fiber treatment agent as shown in FIG. 1. A metal friction body 13 of circular cylindrical shape was disposed such as to be immersed in the 1% emulsion 12 inside the container 11. Free rollers 14 and 15 were respectively disposed at positions of an upper portion of the container 11 at the front and rear of the metal friction body 13. A polyester filament 16 was passed along the free roller 14, the metal friction body 13, and the free roller 15, in that order.

In the state of FIG. 1, the polyester filament 16 was pulled at a speed of 50 m/minute in a direction of an arrow A. A tension T1 at an upstream portion of the free roller 14 and a tension T2 at a downstream portion of the free roller 15 in this state were measured under a condition where a temperature of the 1% emulsion 12 was controlled at 20° C.±0.5° C. in a thermostatic chamber maintained at 20° C. and 65% RH. T2/T1 was calculated and the drawing property was evaluated according to criteria given below. Results are indicated in the "Drawing property" column of Table 5.

Evaluation Criteria of Drawing Property

◎ (satisfactory): T2/T1 is less than 6.00

○ (fair): T2/T1 is not less than 6.00 but less than 6.30 x (poor): T2/T1 is not less than 6.30

Experimental Part 12 (Evaluation of Generated Electricity)

10 kg of the treated polyester staple fibers obtained in Experimental Part 9 were used, fed into a flat card (manufactured by Howa Machinery, Ltd.) under an atmosphere of 25° C.×40% RH, and passed through under a condition of: spinning speed=140 m/minute. Generated electricity of the spun card web was measured and the generated electricity was evaluated according to criteria given below. Results are indicated in the "Generated electricity" column of Table 5.

Evaluation Criteria of Generated Electricity

◎ (satisfactory): The generated electricity amount was less than 0.1 kV.

○ (fair): The generated electricity amount was not less than 0.1 kV but less than 0.3 kV.

x (poor): The generated electricity amount was not less than 0.3 kV.

The synthetic fiber treatment agents of Comparative Examples 6 to 53 are all prepared by mixing the nonionic surfactants (C) in advance at blending ratios falling outside the range of the present invention. It was confirmed that the synthetic fiber treatment agents of Comparative Examples 6 to 53 are all poor in stability properties. On the other hand, as is clear from the evaluation results of Table 2, the stability at room temperature and the stability under temperature change can be improved by the first treatment agent-containing composition of the present invention. Also, fibers to which the synthetic fiber treatment agent constituted by containing such a first treatment agent-containing composition is applied are improved in card passing property, are improved in drawing property and antistatic property, and can exhibit various functions sufficiently. In addition, it has been confirmed that the same effects, that is, the effects of improving card passing property, drawing property, antistatic property, etc., are obtained even in cases where the synthetic fiber treatment agents of the respective examples are applied to a polyethylene fiber, which is a polyolefin fiber.

REFERENCE SIGNS LIST

10 . . . friction testing device
11 . . . container
12 . . . 1% emulsion
13 . . . metal friction body
14, 15 . . . free roller
16 . . . polyester filament

The invention claimed is:

1. A first agent-containing composition for treating synthetic fiber that is combined in use with a second agent for treating synthetic fiber containing a nonionic surfactant (C) described below and is separate from the second agent for treating synthetic fiber when not in use, the first agent-containing composition for treating synthetic fiber comprising a first agent for treating synthetic fiber described below and a solvent (S) described below, wherein assuming that the sum of the amounts of the first agent for treating synthetic fiber and the solvent (S) contained in the first agent-containing composition for treating synthetic fiber is 100 parts by mass, the amount of the first agent for treating synthetic fiber contained in the first agent-containing composition for treating synthetic fiber is not less than 35 parts by mass and not more than 55 parts by mass, the first agent for treating synthetic fiber contains an organic phosphoric acid ester salt (A) described below, an organic phosphoric acid ester salt (B) described below, and optionally a nonionic surfactant (C) described below, the first agent for treating synthetic fiber has a mass ratio of the sum of the contents of the organic phosphoric acid ester salt (A) and the organic phosphoric acid ester salt (B) and the content of the nonionic surfactant (C) such that (organic phosphoric acid ester salt (A)+organic phosphoric acid ester salt (B))/nonionic surfactant (C) is 95/5 to 100/0, assuming that the sum of the amounts of the organic phosphoric acid ester salt (A) and the organic phosphoric acid ester salt (B) contained in the first agent for treating synthetic fiber is 100 parts by mass, the amount of the organic phosphoric acid ester salt (A) contained in the first agent for treating synthetic fiber is not less than 80 parts by mass but less than 100 parts by mass and the amount of the organic phosphoric acid ester salt (B) contained in the first agent for treating synthetic fiber is more than 0 parts by mass but not more than 20 parts by mass, the first agent for treating synthetic fiber has an acid value of more than 0 mg KOH/g but not more than 18 mg KOH/g, as measured by a potentiometric titration method, the solvent (S) has a boiling point at atmospheric pressure of not more than 105° C., the organic phosphoric acid ester salt (A) is an alkali metal salt of an organic phosphoric acid ester having a hydrocarbon group with not less than 16 and not more than 18 carbon atoms, the organic phosphoric acid ester salt (B) is an alkali metal salt of an organic phosphoric acid ester having a hydrocarbon group with not less than 4 and not more than 8 carbon atoms, and the nonionic surfactant (C) has a (poly) oxyalkylene structure in the molecule.

2. The first agent-containing composition for treating synthetic fiber according to claim 1, wherein the acid value of the first agent for treating synthetic fiber measured by the potentiometric titration method is more than 1 mg KOH/g but not more than 16 mg KOH/g.

3. The first agent-containing composition for treating synthetic fiber according to claim 1, wherein the solvent (S) is water.

4. A method for preparing a dilute liquid of synthetic fiber treatment agent, comprising adding, to water, the first agent-containing composition for treating synthetic fiber and the second agent for treating synthetic fiber according to claim 1 such that first agent for treating synthetic fiber/second agent for treating synthetic fiber is 20/80 to 80/20 (mass ratio) and the dilute liquid has a nonvolatile concentration of not less than 0.01% by mass and not more than 10% by mass.

5. The method for preparing a dilute liquid of synthetic fiber treatment agent according to claim 4, comprising a first step and a second step, wherein the first step is a step of adding the first agent-containing composition for treating synthetic fiber and the second agent for treating synthetic fiber to a first water to prepare a dilute liquid of synthetic fiber treatment agent with a nonvolatile concentration of more than 2% by mass but not more than 10% by mass, and the second step is a step of adding a second water to the dilute liquid of synthetic fiber treatment agent prepared in the first step to prepare a dilute liquid of synthetic fiber treatment agent with a nonvolatile concentration of not less than 0.01% by mass and not more than 2% by mass.

6. The method for preparing a dilute liquid of synthetic fiber treatment agent according to claim 5, wherein the first step includes adding the first agent-containing composition for treating synthetic fiber and the second agent for treating synthetic fiber to water of not less than 60° C. and not more than 95° C. that is of not less than 20% by mass and not more than 70% by mass of the total amount of the first water and thereafter further adding the remaining first water of not more than 40° C.

7. The method for preparing a dilute liquid of synthetic fiber treatment agent according to claim 5, wherein the first step includes adding the first agent-containing composition for treating synthetic fiber to water of not less than 60° C. and not more than 95° C. that is of not less than 20% by mass and not more than 70% by mass of the total amount of the first water, thereafter further adding the remaining first water of not more than 40° C., and then further adding the second agent for treating synthetic fiber.

8. A method for treating synthetic fiber, comprising applying, to a synthetic fiber, a dilute liquid of synthetic fiber treatment agent obtained by adding the first agent-containing composition for treating synthetic fiber and the second agent for treating synthetic fiber according to claim 1 to water.

9. A method for producing synthetic fiber, comprising applying, to a synthetic fiber, a dilute liquid of synthetic fiber treatment agent obtained by adding the first agent-containing composition for treating synthetic fiber and the second agent for treating synthetic fiber according to claim 1 to water.

10. A method for producing short fiber, comprising applying, to a synthetic fiber, a dilute liquid of synthetic fiber treatment agent obtained by adding the first agent-containing composition for treating synthetic fiber and the second agent for treating synthetic fiber according to claim 1 to water.

* * * * *